US006994175B2

(12) United States Patent
Egerstrom

(10) Patent No.: US 6,994,175 B2
(45) Date of Patent: Feb. 7, 2006

(54) HYDRAULIC DRILL STRING

(75) Inventor: Fredrik Egerstrom, Nacka (SE)

(73) Assignee: Wassara AB, Stockholm (SE)

( * ) Notice: Subject to any disclaimer, the term of this patent is extended or adjusted under 35 U.S.C. 154(b) by 233 days.

(21) Appl. No.: 10/638,705

(22) Filed: Aug. 11, 2003

(65) Prior Publication Data

US 2004/0188146 A1 Sep. 30, 2004

(30) Foreign Application Priority Data

Mar. 26, 2003 (SE) ..... 0300836

(51) Int. Cl.
*E21B 4/14* (2006.01)

(52) U.S. Cl. ..... 175/296; 173/135; 173/136

(58) Field of Classification Search ..... 175/296, 175/293; 173/135, 136
See application file for complete search history.

(56) References Cited

U.S. PATENT DOCUMENTS

| | | | | |
|---|---|---|---|---|
| 3,084,673 A | * | 4/1963 | Sears | 173/17 |
| 3,229,776 A | * | 1/1966 | Collier | 173/17 |
| 3,527,239 A | * | 9/1970 | Boom | 173/64 |
| 4,883,133 A | * | 11/1989 | Fletcher et al. | 175/93 |
| 5,107,944 A | | 4/1992 | Gustafsson | |
| 5,131,476 A | * | 7/1992 | Harrington | 173/17 |
| 6,135,216 A | * | 10/2000 | Lyon et al. | 175/296 |

* cited by examiner

*Primary Examiner*—David Bagnell
*Assistant Examiner*—Giovanna M. Collins
(74) *Attorney, Agent, or Firm*—Mark P. Stone

(57) ABSTRACT

A hydraulic drill string device can be in the form of a percussive hydraulic in-hole drilling machine that has a piston hammer (50) with an axial through hole (51) into which a tube (35) extends. The tube forms a channel for flushing fluid from a spool valve (62) and the tube wall contains channels (40) with ports (41,42) cooperating with the piston hammer for controlling the valve.

38 Claims, 2 Drawing Sheets

HYDRAULIC DRILL STRING

TECHNICAL FIELD

The invention relates to a hydraulic drill string device for use in a drill string for drilling a bore hole in an earth formation.

PRIOR ART

In U.S. Pat. No. 5,107,944 a hydraulic drill string device, in the form of a percussion drilling machine, is described. The described percussion drilling machine is provided with an annular drive piston reciprocable in a cylinder provided in a housing chest. The drive piston has a drive surface for interaction with a pressurised driving liquid. The drive piston forms an integral piece with a percussion hammer that is arranged to perform a reciprocating movement in a chamber formed by the outer casing of the drill string driven by the piston. The percussion hammer is arranged to impact on a drill bit on its forward movement.

The annular drive piston is received in the housing chest. The centre bore in the annular drive piston is provided with a bypassing passage in the form of a central duct or tube extending within the annular drive piston, for bypassing the drive surface of the drive piston and allowing passage of a low pressure flushing liquid to the drill bit. The housing chest, located on the exterior of the annular piston, is provided with channels for passage of pressurised liquid bypassing the drive surface.

These channels couple with annular recesses provided in the peripheral outer surface of the drive piston, either continuously, or intermittingly as dictated by the reciprocal position of the drive piston. The intermittingly connected recesses form control grooves or timing ports for the pressurised liquid. The resulting intermittingly timed pressurised liquid drives a control valve controlling the supply and release of the driving liquid on the annular piston's drive surface.

OBJECT OF INVENTION

It is an object of the invention to increase the power that is deliverable by the hydraulic drill string device.

GENERAL DESCRIPTION OF THE INVENTION

In accordance with the invention there is provided a hydraulic drill string device for use in a drill string for drilling a bore hole in an earth formation, the drill string device comprising a housing, annular piston means provided in the housing arranged to perform a reciprocating movement relative to the housing and to drive a tool, the annular piston means having a driving surface for interacting with a driving liquid, the drill string device further comprising a bypassing passage extending within the annular piston means for allowing liquid bypassing the driving surface, which bypassing passage comprises at least two separate channels.

In this arrangement, one of the channels in the bypassing passage can be devoted to allow passage of, for instance, flushing fluid at a relatively low pressure, while at the same time the other passage is available as a supply passage for passage of, for instance, a pressurised fluid in the form of a driving liquid or a control liquid at a relatively high pressure. Thus, one or more of the channels in the housing chest can be dispensed with, thereby reducing the cross sectional area that needs to be occupied by the housing chest. The space that comes available allows for increasing the drive surface of the annular piston on its outer rim, providing a higher power transmittable to the annular piston.

In particular since the drive surface of the annular piston is enlarged on its outer rim, the increase in active area of the drive surface is relatively high compared to increasing the drive surface towards its centre. So even if bringing a channel from the housing chest to the bypassing passage extending within the annular piston is only possible by sacrificing some of the piston's drive surface on its centre, the available active area of the drive surface would still increase.

In an advantageous embodiment, the peripheral inner surface of the annular piston means is provided with one or more recesses being arranged in continuous or intermitting fluid communication with one or more of the at least two separate channels. Such recess can perform the function of a timing port in cooperation with one or more of the separate channels in the bypassing passage. Herewith it is achieved that control channels can be included in the bypassing passage.

As indicated above, one of the two separate channels can be a supply channel having a supply channel inlet and a supply channel outlet, the supply channel inlet arranged for connecting to a source of pressurised liquid. Thereby the pressurised liquid can bypass the drive surface and be utilised elsewhere instead.

In a preferred embodiment of the invention including such a supply channel, the hydraulic drill string device further comprises a control channel having a control channel inlet and a control channel outlet, whereby one of the one or more recesses in the peripheral inner surface of the annular piston means is arranged to intermittingly establish fluid communication between the supply channel outlet and the control channel inlet as dictated by said reciprocating movement of the annular piston means. In this embodiment, the reciprocating movement of the annular piston means serves to intermittingly pressurise the control channel, which modulated pressure can then be utilised as a control pressure for intermittingly pressurising an area in timing sync with the annular piston means.

Advantageously both the supply channel and the control channel are provided as separate channels in the bypassing passage. Herewith the driving surface of the piston means can be bypassed twice, such as to gain access to the control pressure on the same side of the driving surface of the piston means as the supply channel inlet.

In a particular embodiment of the invention, one of the at least two channels is a pressure discharge channel having a pressure discharge channel inlet in fluid communication with a pressure chamber, and a pressure discharge channel outlet connectable to a discharge space.

In a preferred embodiment with such a pressure discharge channel, one of the one or more recesses in the peripheral inner surface of the annular piston means is arranged to intermittingly establish fluid communication between the pressure discharge channel outlet and the discharge space that in operation is maintainable at a lower pressure than the pressure chamber. Such discharge space may be provided in the form of a flushing channel. In this embodiment, the pressure chamber is intermittingly pressure relieved in sync with the reciprocating movement of the piston means.

Preferably, the hydraulic drill string device comprises both said control channel and said pressure discharge channel, whereby the control channel inlet is in intermitting fluid communication with the supply channel outlet and alternating to that the pressure discharge channel outlet is in fluid communication with the discharge space. Herewith it is achieved that the pressure chamber can be alternately pressurised and pressure relieved in sync with the piston reciprocation.

In a particularly advantageous embodiment, the pressure discharge channel and the control channel are combined into one single channel. This is an attractive option for simplifying an otherwise complicated structure.

In an embodiment, the hydraulic drill string device further comprises valve means for controlling the supply and discharge of the driving liquid to the driving surface. In such an embodiment, the control channel and/or discharge channel can advantageously be employed for controlling the valve means into assuming a supply position or a discharge position in dependence of the reciprocative position of the annular piston means. Herewith it is achieved that the supply and discharge of the driving liquid to the driving surface of the piston is controlled by the valve means as actuated by the reciprocation of the annular piston means, so that the driving liquid is supplied for interacting with the driving surface when the annular piston means is in its rearward position for driving it in forward movement, and the driving liquid is discharged for allowing rearward movement of the annular piston means.

A hydraulic drill string device in accordance with any one of the above described embodiments of the invention, can be in the form of a percussive hydraulic in-hole rock drilling machine. Such a hydraulic in-hole rock drilling machine can comprise a percussion hammer and connection means for connecting a drill bit, whereby the annular piston means is arranged to drive the percussion hammer into a reciprocating movement and the percussion hammer is arranged to impact on the drill bit when it is connected.

A particularly attractive embodiment of the invention may thus be defined as a hydraulic in-hole rock drilling machine comprising:

a housing;

a drill bit mounted in the front end of the housing and having a through axial flushing fluid channel;

a piston hammer in the housing having a through axial channel and being arranged to impact on the drill bit;

means for connecting the machine to a tubular drill string;

an inlet for receiving pressurised hydraulic motive fluid from the drill string, a tube fixed in the housing and extending with a sliding fit into the rear end of the axial channel in the piston hammer, the rear annular end of the piston hammer forming a first piston surface in a first annular cylinder chamber for moving the piston hammer forwards;

a second annular piston surface of the piston hammer in a second annular cylinder chamber for moving the piston hammer rearwards;

a valve coupled to said inlet and having a first operative position for pressurising said first cylinder chamber and a second position for draining the first cylinder chamber to the tube, thereby to reciprocate the piston and to provide flushing fluid to the flushing fluid channel in the drill bit;

a control conduit with port means controlled by the axial position of the piston hammer for actuating the valve to shift between its positions; whereby the piston hammer has first and second annular recesses in its surface that is in sliding fit with the tube;

passage means is arranged for pressurising said first recess;

said control conduit extends in the tube and has said port means arranged to be alternately open to said first and second recesses in response to the movement of the piston hammer; and said second recess is arranged to be in communication with the bore in the piston hammer at least when the piston is in rear position.

BRIEF DESCRIPTION OF THE DRAWINGS

The invention will be explained hereinafter with reference to a detailed embodiment by way of example, and with reference to the drawing wherein FIGS. 1*a*, 1*b*, and 1*c* form together a longitudinal section through the drilling machine taken along the lines 1—1 in the FIGS. 3 and 4.

DESCRIPTION OF THE ILLUSTRATED AND PREFERRED EMBODIMENT

Figure 4:
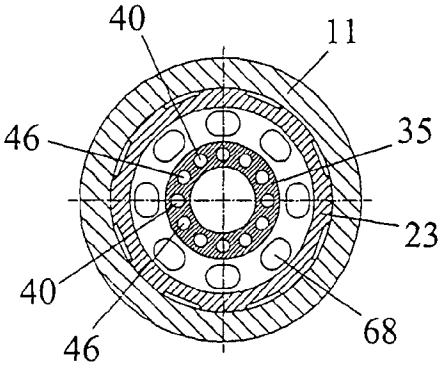
FIG. 4 shows a transverse section taken along the lines 4—4 in FIG. 1*b*.

The hydraulic in-rock drilling machine shown in the figures has a machine housing that comprises a machine housing tube 11, a front end bushing 12 fastened to the tube 11 for instance by being screwed thereto, and a back head in the form of a drill string adapter 13, preferably fastened to the housing tube 11 by being screwed thereto.

The front end bushing 12 retains a drill bit 15, which can be a conventional one. The drill bit 15 has a head 16 and a shank 17. The shank has a splined connection 18 to the bushing 12 and a portion 19 without splines. A ring 20 is clamped between the bushing 12 and the machine tube 11 and it prevents the drill bit from falling out. The ring 20 is axially split so that it can be mounted. Thus the drill bit 15 can be axially movable between its rear end position in which it is shown when its head takes support against the end of the bushing 12 and a forward position in which the rear portion 21 of the splines rests on the ring 20. The drill bit 15 has a central flushing fluid channel leading from its shank 17 to the front end of the bit for supplying flushing fluid.

The adapter 13 clamps a row of elements against an inward shoulder 22 in the front end of the machine housing tube 11. This row of elements comprises an annular element 23 forming a liner, a rear annular guiding element 24, a distance sleeve 25, a forward annular guiding element 26, and a bushing 27.

Inside the adapter 13 is a strainer holder 30 with a head 31 clamped against the liner 23. The head 31 forms an abutment for a set of bevel plate springs 32 that through a ring 33 clamps a sleeve 34 and a tube 35 against an inward shoulder 36 in the liner 23. The head 31 and the springs have a central hole and a nozzle 37 is arranged to permit a flow out of the strainer holder. A strainer or filter 28 is mounted in the strainer holder and liquid from the drill string will flow through the strainer 28 and out through holes 29 in the strainer holder 30. The tube 35 has a plurality of channels 40 with ports 41 and 42 and ports 43. The ports 43 are open to an annular space 44. The tube has also a plurality of supply channels 46 which have supply channel inlets and supply channel outlets in the form of ports 47 and 48.

A piston hammer 50, being an integral piece including a piston section and a hammer section, is guided in the spaced guiding elements 24, 26 and it has a longitudinal channel 51 that has a widened rear portion 52. The rear end of the piston hammer extends slidingly into the annular cylindrical space between the tube 35 and the liner 23 and its rear end surface 53 is in a first annular cylinder chamber 54. A second annular cylinder chamber 55 is formed between the liner 23 and the outer surface of the piston hammer and an annular piston surface 56 on a head 57 of the piston hammer. The two guiding elements 24, 26 have the same internal diameter for guiding the piston hammer so that the space between them will maintain a constant volume during the reciprocation of the hammer. The wall of the widened portion 52 of the channel 51 of the hammer slides against the outer surface of the tube 35. The inner wall of the hammer has a first annular recess 58 and a second annular recess 59. The front end of the piston hammer has a diametrically reduced portion 60 so that a damping chamber 61 is formed.

Figure 1A:
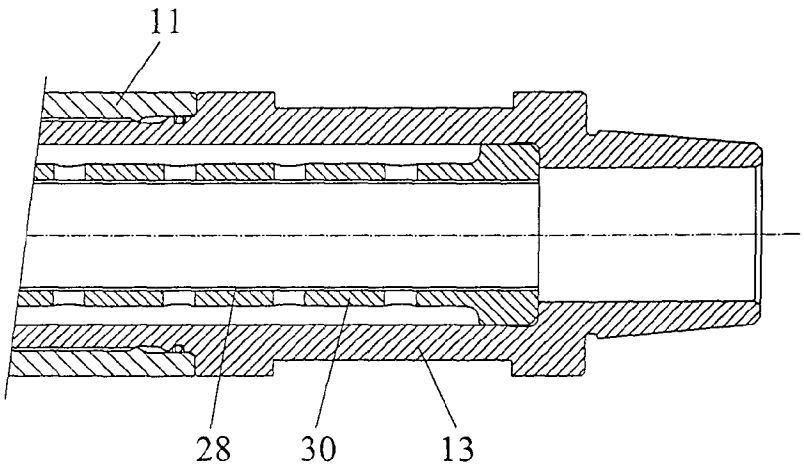
FIG. 1*a* showing the front portion of the machine, FIG. 1*b* showing the middle portion of the machine, and FIG. 1*c* showing the rear portion of the machine.
Figure 1C:
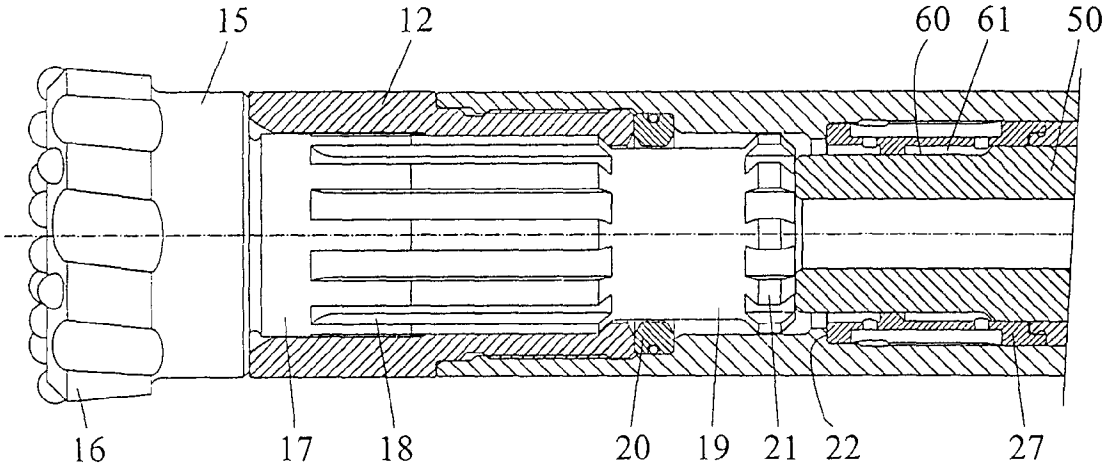
Figure 3:
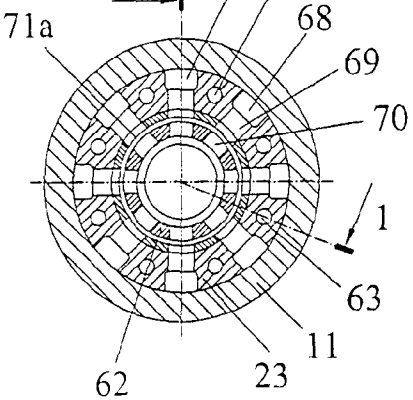
FIG. 3 shows a transverse section taken along the lines 3—3 in FIG. 1*b*.
Figure 1B:
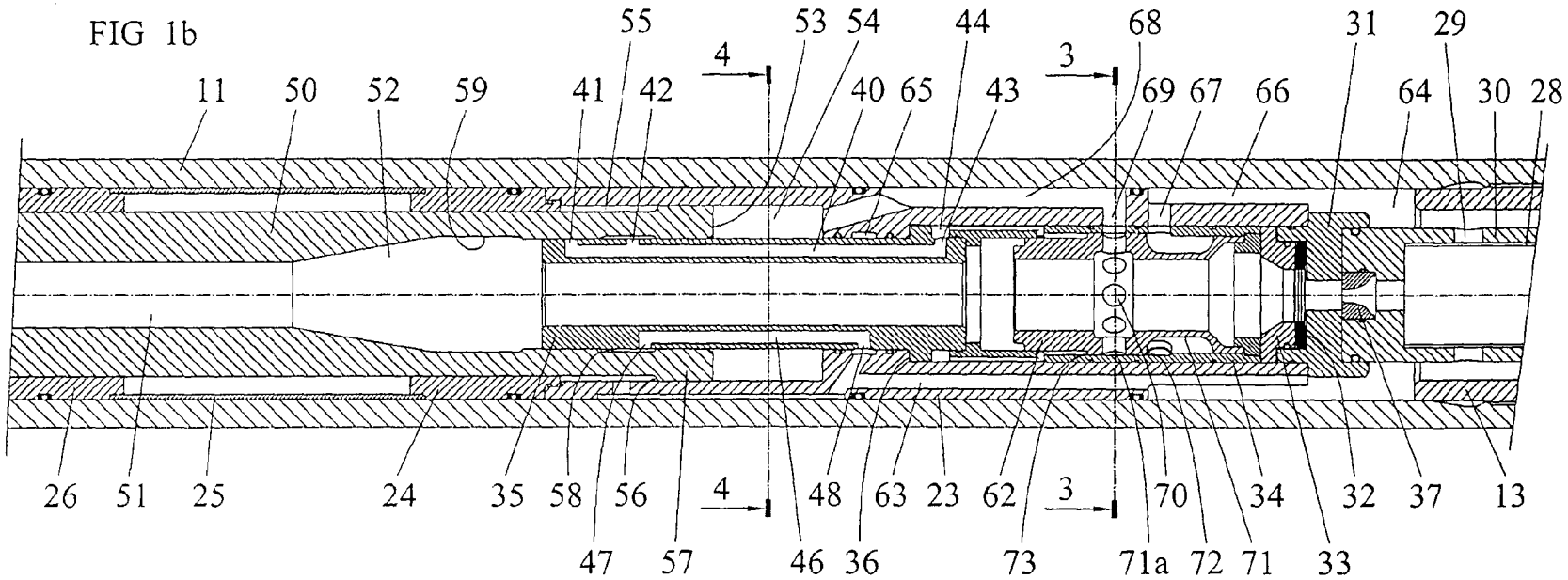
Figure 2:
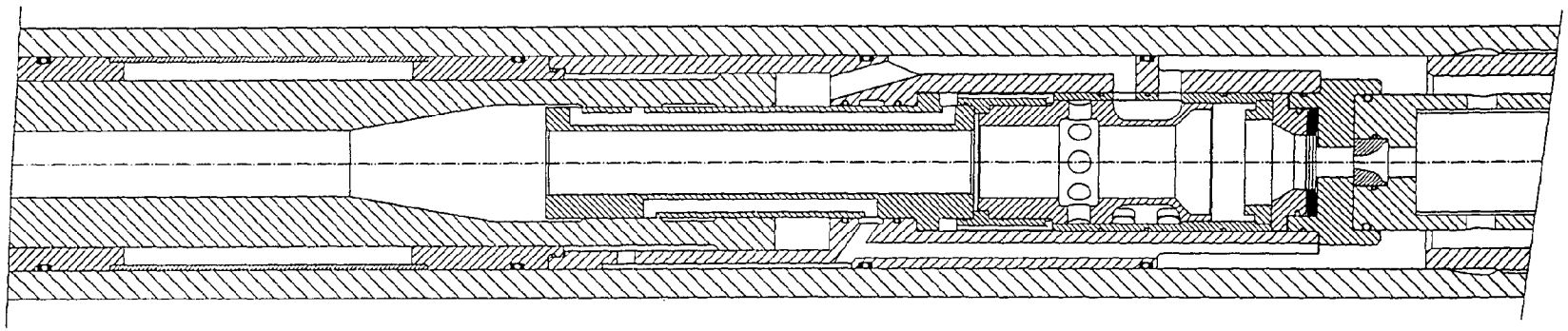
FIG. 2 corresponds to FIG. 1*b* but shows some elements in other relative positions.

A valving element in the form of a valve spool 62 is slidable in the sleeve 34 and it is shown in its forward position in FIG. 2 and in its rear position in FIG. 1*b*. The sleeve 34 is thus a cylinder for the valve spool.

A plurality of channels 63 lead from an annular space 64 outside of the strainer holder 30 to the cylinder chamber 55 and to an annular recess 65 open to the port 48. The annular space 64 extends at 66 outside of the line 23 to ports 67 in the sleeve 34. Thus, the adapter 13 and the space 64 form an inlet for motive fluid from the drill string. A plurality of channels 68 with ports 69 in the sleeve 34 lead to the cylinder chamber 54.

The valve spool 62 is hollow and it has a row of holes 70 between its outer and inner surfaces and the holes end in an annular recess 71*a* in order to make the functioning of the spool independent of its angular position. In its rear position shown in FIG. 1*b*, the valve spool couples, via its holes 70, the first annular cylinder chamber 54 to the interior of the spool and thereby to the flushing fluid channel formed by the interior of the spool, the tube 35, the central channel 51 in the piston, and the flushing fluid channel in the drill bit. In its forward position in which it is shown in FIG. 2, the valve spool 62 instead couples the space 64 outside of the strainer holder 30 to the first annular cylinder chamber 54 via a waist 71 in the valve spool.

The outer diameter of the spool forwardly of the waist 71 is somewhat larger than the outer diameter rearwardly of the waist so that a differential surface 72 is formed, which is continuously subjected to high pressure for biasing the valve spool forwardly to the valve position of FIG. 2. The valve spool has also an annular control surface 73, which is larger than the control surface 72, for example twice as large, and this control surface 72 is coupled to the annular space 44 which extends all the way to the control surface 72. Thus, the passages 40 in the tube 35 and the annular space 44 form a control channel for shifting the position of the valve. When the control channel 40 is pressurised, the valve moves to its position shown in FIG. 1*b* and when the control channel 40 is coupled to a low pressure it acts as a discharge channel so that the valve moves into its position shown in FIG. 2.

As described, the central hole in the tube 35 and the channels 40 and 46 form channels that bypasses the piston surface 53 and the cylinder chamber 54.

The guiding elements in the form of guide bushings 24, 26 have equal diameter so that the space between them will maintain a constant volume as the piston hammer moves. No dynamic seals will then be necessary which increases the expected life. The guide bushings 24, 26 and the piston hammer can preferably be made of so called hard metal, that is tungsten carbide or corresponding material, which will minimize the wear and further increase the expected life. The sliding surfaces of the piston hammer against the tube 35 are also important for the expected life and the tube should preferably also be made of carbide. In the same way, the spool valve and its housing 34 should be made of hard metal.

With the use of hard metal as described and no dynamic seals, it will be possible not only to use water as motive fluid, but also to use water or other liquids containing solids in suspension. It will even be possible to recycle the suspension after removing the debris despite the fact that the finest debris cannot be removed.

The thermal expansion of tungsten carbide is much smaller than the thermal expansion of steel and the bevel springs 32 that clamps the carbide parts will ensure that no gap will occur between the steel parts and the carbide parts if the machine will be heated. If the machine is used in exploration drilling for gas, the temperatures can be very high.

The nozzle 37 is replaceable and it is chosen to adapt the flushing fluid flow to the actual need. The nozzle can even be replaced by a plug when no additional flushing fluid is necessary.

DESCRIPTION OF THE OPERATION

In operation, the drilling machine is in a borehole in rock and the drill string is rotated and applies a feeding force to the drilling machine so that the drill bit 15 is forced against the bottom of the borehole, and a high pressure liquid motive fluid is supplied through the drill string to the adapter, that is, to the inlet of the drilling machine. The piston hammer 50 reciprocates and impacts on the end surface of the shank 17 of the drill bit 15. In FIGS. 1*a* and 1*c*, the piston hammer 50 is shown in its impacting position. Before the piston hammer 50 had reached its impacting position in its work stroke, the port 42 opened to the annular recess 58, which was pressurised from the supply channel 46, so that the channel 40, 44 was pressurised and the pressure on the control surface 73 moved the valve spool 62 to its position shown in FIG. 1*b* so that the valve spool 62 discharges the first annular cylinder chamber 54 to the flushing fluid conduit that leads through the piston hammer. Thus, the pressure in the second annular cylinder chamber 55 forces the piston hammer 50 to move rearwards in its return stroke. During the return stroke of the piston hammer, the port 41 of the control channel 40, 44 opens to the recess 59 to drain the control channel 40, and as a result, the valve spool 62 switches over to its position shown in FIG. 2 so that the waist 71 of the valve spool 62 couples the cylinder chamber 54 to high pressure and this pressure on the rear end surface 53 of the piston hammer 50 retards the piston hammer and makes it turn and start its work stroke. Then again, the valve shifts position just before the hammer piston impacts on the drill bit and the hammer starts its return stroke and the cycle is repeated. The impact frequency may for example be between 50 and 100 Hz.

What is claimed is:

1. An hydraulically operated percussive in-hole rock drilling machine comprising:

a housing (11);

a drill bit (15) mounted in the front end of the housing and having a through axial flushing fluid channel;

a piston hammer (50) in the housing having a through axial channel (51) and being arranged to impact on the drill bit;

means (13) for connecting the machine to a tubular drill string;

an inlet (64) for receiving pressurized hydraulic motive fluid from said drill string;

a tube (35) fixed in the housing and extending with a sliding fit into the rear end of the axial channel (51) in the piston hammer (50), the piston hammer having a rear annular end forming a first piston surface (53) in a first annular cylinder chamber (54) for moving the piston hammer in a forward direction;

said piston hammer having a second annular piston surface (56) in a second annular cylinder chamber (55) for moving the piston hammer in a rearward direction;

a valve (62) coupled to said inlet (64) and having a first operative position for pressurizing said first cylinder chamber (54) and a second position for draining the first cylinder chamber to the tube (35), for reciprocating the piston hammer and providing flushing fluid to the drill bit;

a control conduit (40) with port means (41, 42) controlled by the axial position of the piston hammer for actuating the valve to shift between said first and second positions;

wherein:

the piston hammer (50) has first and second annular recesses (58, 59) in the surface thereof that is in sliding fit with the tube (35);

passage means (46) is arranged for pressurizing said first recess (58);

said control conduit (40) extends in said tube (35) such that said port means (41, 42) are arranged to be alternately open to said first and second recesses (58, 59) in response to movement of the piston hammer; and said second recess (59) is arranged to be in communication with the channel (51) in the piston hammer at least when said piston is in a rear position.

2. A machine according to claim 1, further comprising a bypassing passage extending within the piston hammer for allowing liquid bypassing a driving surface of the piston hammer, which bypassing passage comprises at least two separate channels or conduits.

3. A machine according to claim 2, wherein a peripheral inner surface of the piston hammer is provided with said first recess arranged in intermittent fluid communication with one or more of the at least two separate channels or conduits.

4. A machine according to claim 2, wherein one of the at least two separate channels or conduits comprises said passage means, said passage means providing a supply channel having a supply channel inlet connectable to a source of pressurized liquid and having a supply channel outlet.

5. A machine according to claim 4, wherein said control conduit has a control conduit inlet and a control conduit outlet, and whereby said first recess in a peripheral inner surface of the piston hammer is arranged to intermittently establish a fluid communication between the supply channel outlet and the control conduit inlet upon said reciprocating movement of the piston hammer.

6. A machine according to claim 5, wherein the bypassing passage comprises the supply channel and the control conduit.

7. A machine according to claim 5, wherein one of the at least two channels or conduits is a pressure discharge channel having a pressure discharge channel inlet in fluid communication with a pressure chamber and having a pressure discharge channel outlet connectable to a discharge space.

8. A machine according to claim 7, whereby said first recess in a peripheral inner surface of the piston hammer is arranged to intermittently establish fluid communication between the pressure discharge channel outlet and the discharge space that in operation is maintainable at a lower pressure than the pressure chamber.

9. A machine according to claim 8, wherein the discharge space is a flushing channel.

10. A machine according to claim 9, wherein the control conduit inlet is in intermittent fluid communication with the supply channel outlet and alternating so that the pressure discharge channel outlet is in fluid communication with the flushing channel.

11. A machine according to claim 9, wherein the control conduit inlet is in intermittent fluid communication with the supply channel outlet and alternating so that the pressure discharge channel outlet is in fluid communication with the flushing channel.

12. A machine according to claim 11, wherein the pressure discharge channel and the control conduit are combined in one single channel.

13. A machine according to claim 3, wherein one of the at least two separate channels or conduits comprises said passage means, said passage means providing a supply channel having a supply channel inlet connectable to a source of pressurized liquid and having a supply channel outlet.

14. A machine according to claim 13, wherein one of the at least two separate channels or conduits comprises said control conduit having a control conduit inlet and a control conduit outlet, and whereby said first recess in the peripheral inner surface of the piston hammer is arranged to intermittently establish fluid communication between the supply channel outlet and the control conduit inlet upon reciprocating movement of the piston hammer.

15. A machine according to claim 2, wherein the bypassing passage comprises said tube (35) fixed with respect to the housing and extending with a sliding fit into the piston hammer and bypassing the driving surface of said piston hammer.

16. A machine according to claim 15, wherein the tube is provided with an inner tube extending in an outer tube, the piston hammer being in sliding fit with the outer tube whereby one or more of the at least two separate channels or conduits extend in an annular space that is formed between the inner tube and the outer tube.

17. A machine according to claim 1, wherein the piston area of said first piston surface (53) is greater than the piston area of said second piston surface (56).

18. A machine according to claim 17, wherein said second recess (59) is defined forwardly of said first recess (58).

19. A machine according to claim 1, wherein said second recess (59) is defined forwardly of said first recess (58).

20. A machine according to claim 1, wherein said second cylinder chamber (55) is positioned on the outside of the piston hammer.

21. A machine according to claim 1, wherein said valve is a spool valve (62) coaxial with said tube (35).

22. A machine according to claim 1, wherein said hydraulic motive fluid is water.

23. A machine according to claim 1, wherein said hydraulic motive fluid comprises water containing solids in suspension.

24. A machine according to claim 1, wherein said hydraulic motive fluid is a liquid other than water.

25. A machine according to claim 1, wherein said hydraulic motive fluid comprises a liquid other than water containing solids in suspension.

26. A machine according to claim 1, wherein said piston hammer (50) is guided in two axially spaced guide bushings (24, 26) having equal internal diameter so that a space formed between them will maintain constant volume when the piston hammer moves.

27. A machine according to claim 1, wherein said valve (62) is formed as a spool and is slideable in a sleeve between forward and rear positions.

28. A machine according to claim 27, wherein said spool is hollow and defines a row of holes (70) between outer and inner surfaces of said spool.

29. A machine according to claim 27, wherein said spool defines a waist (71), the outer diameter of said spool forwardly of said waist being larger than the outer diameter of said spool rearwardly of said waist.

30. An hydraulically operated percussive in-hole rock drilling machine comprising:

a housing (11);

a drill bit (15) mounted in the front end of the housing and having a through axial flushing fluid channel;

a piston hammer (50) in the housing having a through axial channel (51) and being arranged to impact on the drill bit;

means (13) for connecting the machine to a tubular drill string;

an inlet (64) for receiving pressurized hydraulic motive fluid from said drill string;

a tube (35) fixed in the housing and extending with a sliding fit into the rear end of the axial channel (51) in the piston hammer (50), the piston hammer having a rear annular end forming a first piston surface (53) in a first annular cylinder chamber (54) for moving the piston hammer in a forward direction;

said piston hammer having a second annular piston surface (56) in a second annular cylinder chamber (55) for moving the piston hammer in a rearward direction;

a valve (62) coupled to said inlet (64) and having a first operative position for pressurizing said first cylinder chamber (54) and a second position for draining the first cylinder chamber to the tube (35), for reciprocating the piston hammer and providing flushing fluid to the drill bit;

a control conduit (40) with port means (41, 42) controlled by the axial position of the piston hammer for actuating the valve to shift between said first and second positions;

wherein:

the piston hammer (50) is guided in two axially spaced guide bushings (24, 26) having equal internal diameter so that a space formed between them will maintain constant volume when the piston hammer moves.

31. A machine according to claim 30, wherein said valve (62) is formed as a spool and is slideable in a sleeve between forward and rear positions.

32. A machine according to claim 31, wherein said spool is hollow and defines a row of holes (70) between outer and inner surfaces of said spool.

33. A machine according to claim 31, wherein said spool defines a waist (71), the outer diameter of said spool forwardly of said waist being larger than the outer diameter of said spool rearwardly of said waist.

34. An hydraulically operated percussive in-hole rock drilling machine comprising:

a housing (11);

a drill bit (15) mounted in the front end of the housing and having a through axial flushing fluid channel;

a piston hammer (50) in the housing having a through axial channel (51) and being arranged to impact on the drill bit;

means (13) for connecting the machine to a tubular drill string;

an inlet (64) for receiving pressurized hydraulic motive fluid from said drill string;

a tube (35) fixed in the housing and extending with a sliding fit into the rear end of the axial channel (51) in the piston hammer (50), the piston hammer having a rear annular end forming a first piston surface (53) in a first annular cylinder chamber (54) for moving the piston hammer in a forward direction;

said piston hammer having a second annular piston surface (56) in a second annular cylinder chamber (55) for moving the piston hammer in a rearward direction;

a valve (62) coupled to said inlet (64) and having a first operative position for pressurizing said first cylinder chamber (54) and a second position for draining the first cylinder chamber to the tube (35), for reciprocating the piston hammer and providing flushing fluid to the drill bit;

a control conduit (40) with port means (41, 42) controlled by the axial position of the piston hammer for actuating the valve to shift between said first and second positions;

wherein:

the piston hammer (50) is guided in two axially spaced carbide guide bushings (24, 26), said piston hammer being of carbide.

35. A machine according to claim 34, wherein said two axially spaced carbide guide bushings (24, 26) have equal internal diameter so that a space formed between them will maintain constant volume when the piston hammer moves.

36. A machine according to claim 34, wherein said valve (62) is formed as a spool and is slideable in a sleeve between forward and rear positions.

37. A machine according to claim 36, wherein said spool is hollow and defines a row of holes (70) between outer and inner surfaces of said spool.

38. A machine according to claim 36, wherein said spool defines a waist (71), the outer diameter of said spool forwardly of said waist being larger than the outer diameter of said spool rearwardly of said waist.

* * * * *